US011529676B2

(12) United States Patent
Nooning, Jr. et al.

(10) Patent No.: US 11,529,676 B2
(45) Date of Patent: Dec. 20, 2022

(54) METHOD FOR ALTERING CASTING ROLL PROFILE WITH THE ALTERATION OF LOCALIZED TEMPERATURE

(71) Applicant: NUCOR CORPORATION, Charlotte, NC (US)

(72) Inventors: Robert G. Nooning, Jr., Zionsville, IN (US); Wilhelm Schmitz, Baesweiler (DE); Roland Sellger, Ratingen (DE); Ulrich Albrecht-Frueh, Krefeld (DE)

(73) Assignee: NUCOR CORPORATION, Charlotte, NC (US)

( * ) Notice: Subject to any disclaimer, the term of this patent is extended or adjusted under 35 U.S.C. 154(b) by 0 days.

(21) Appl. No.: 17/054,077

(22) PCT Filed: May 9, 2019

(86) PCT No.: PCT/US2019/031550

§ 371 (c)(1),
(2) Date: Nov. 9, 2020

(87) PCT Pub. No.: WO2019/217700

PCT Pub. Date: Nov. 14, 2019

(65) Prior Publication Data

US 2021/0237147 A1 Aug. 5, 2021

Related U.S. Application Data

(60) Provisional application No. 62/669,079, filed on May 9, 2018.

(51) Int. Cl.
*B22D 11/06* (2006.01)
*B22D 11/16* (2006.01)

(52) U.S. Cl.
CPC ..... *B22D 11/0671* (2013.01); *B22D 11/0622* (2013.01); *B22D 11/16* (2013.01)

(58) Field of Classification Search
CPC . B22D 11/06; B22D 11/0622; B22D 11/0637; B22D 11/0665; B22D 11/0671; B22D 11/16

(Continued)

(56) References Cited

U.S. PATENT DOCUMENTS 6,575,225 B1 6/2003 Hohenblicher et al.
2003/0116301 A1 6/2003 Blejde et al.

(Continued)

FOREIGN PATENT DOCUMENTS

CN 201150979 Y * 11/2008 ..... B22D 11/06
EP 2 357 051 8/2011
WO 2015028370 3/2015

OTHER PUBLICATIONS

Machine translation of CN 201150979 Y (Year: 2008).*

(Continued)

*Primary Examiner* — Kevin P Kerns
(74) *Attorney, Agent, or Firm* — Hahn Loeser & Parks LLP

(57) ABSTRACT

An apparatus for continuously casting thin strip has a pair of internally cooled counter-rotatable casting rolls having casting surfaces, the pair of casting rolls laterally positioned to form a gap at a nip between the casting rolls through which a thin metal strip can be cast, where the casting surface of each casting roll has a roll profile extending in an axial direction of the corresponding casting roll; a metal delivery system adapted to deliver molten metal above the nip to form a casting pool; and a temperature altering source external to the casting roll and having one or more zones configured to alter the casting roll profile of at least one of the pair of casting rolls by locally heating or cooling the casting roll.

24 Claims, 9 Drawing Sheets

(58) Field of Classification Search
USPC ..... 164/452, 463, 480, 428, 151.4, 154.7
See application file for complete search history.

(56) References Cited

U.S. PATENT DOCUMENTS

| | | | |
|---|---|---|---|
| 2006/0124271 | A1 | 6/2006 | Schlichting et al. |
| 2009/0049882 | A1 | 2/2009 | Flick et al. |
| 2010/0032126 | A1 | 2/2010 | Schlichting et al. |
| 2013/0126120 | A1 | 5/2013 | Nooning et al. |
| 2013/0145595 | A1 | 6/2013 | Mcquillis et al. |
| 2014/0290898 | A1 | 10/2014 | Dagner et al. |
| 2017/0113299 | A1 | 4/2017 | Hwang et al. |
| 2017/0327925 | A1 | 11/2017 | Watson et al. |

OTHER PUBLICATIONS

International Search Report regarding PCT/US2019/031550, dated Jul. 26, 2019 (2pgs.).
Written Opinion of the International Search Report regarding PCT/US2019/031550, dated Jul. 26, 2019 (6pgs.).
Extended European Search Report related to EP 19799351.2, dated Apr. 9, 2021 (9pgs.).

* cited by examiner

METHOD FOR ALTERING CASTING ROLL PROFILE WITH THE ALTERATION OF LOCALIZED TEMPERATURE

BACKGROUND

This invention relates to the casting of metal strip by continuous casting using a twin roll caster.

In a twin roll caster, molten metal is introduced between a pair of counter-rotated horizontal casting rolls that are cooled so that metal shells solidify on the moving casting roll surfaces and are brought together at a nip between them to produce a solidified strip product delivered downwardly from the nip between the casting rolls. The term "nip" is used herein to refer to the general region at which the casting rolls are closest together. The molten metal may be poured from a ladle into a smaller vessel or series of smaller vessels from which it flows through a metal delivery nozzle and nozzles located above the nip forming a casting pool of molten metal supported on the casting surfaces of the casting rolls immediately above the nip and extending along the length of the nip. This casting pool is usually confined between side plates or dams held in sliding engagement with end surfaces of the casting rolls so as to restrict the two ends of the casting pool against outflow.

The twin roll caster is capable of continuously producing cast strip from molten steel through a sequence of ladles positioned on a turret. The molten metal is poured from each ladle in turn into a tundish and then into a moveable tundish before flowing through the metal delivery nozzle into the casting pool. The tundish enables the exchange of an empty ladle for a full ladle on the turret without disrupting the production of the cast strip.

In casting thin strip with a twin roll caster, the casting rolls are generally made of copper or copper alloy and are usually coated with chromium or nickel. The casting rolls are cooled internally with cooling water in longitudinal cooling passages enabling rapid solidification of strip during casting. To achieve this, heat fluxes may exceed 10 $MW/m^2$. The casting rolls undergo substantial thermal deformation from exposure to the molten metal or solidified strip and the cooling of the casting rolls. The profile of the casting surface of each casting roll varies during a casting campaign. The profile of each casting surface, in turn, determines the as-cast strip thickness profile, that is, the shape of the opposing sides of the cross-sectional thickness extending in the axial direction of the casting roll, and ultimately the cross-sectional thickness shape. For example, casting rolls with a convex casting surface (i.e., a positive roll profile) produce cast strip having a cross-sectional thickness with a concave thickness profile (i.e., a negative thickness profile). Conversely, casting rolls with concave casting surface (i.e., a negative roll profile) produce cast strip having a cross-sectional thickness with a convex thickness profile (i.e., a positive thickness profile). As such, the roll profile of each casting surface of the casting rolls is used to produce a desired strip cross-sectional thickness profile of the thin metal strip under typical casting conditions. It is noted that the crown profile is a portion of the roll profile located more centrally along the casting roll length.

In thin strip casting, the casting rolls are usually machined when cold with an initial roll profile based on a projected casting roll profile of a corresponding casting roll during strip casting. However, the differences of the shape of the casting surfaces of the casting rolls between cold conditions and casting conditions are difficult to predict. Moreover, the roll profile of each casting roll can vary significantly during the casting campaign. The roll profile of the casting surfaces of the casting rolls can change during casting due to changes in temperature of the molten metal supplied to the casting pool of the caster, to changes in casting speed of the casting rolls, and to other casting conditions, such as slight changes in molten steel composition.

As the casting surfaces at the nip define the as-cast strip thickness, it follows that the thickness profile of the cast steel strip is primarily dependent on the roll profile of the heated casting rolls at the nip. The expansion of the casting rolls in any given location is determined primarily by the local temperature of the rolls, and thus the heat transfer between the steel and the rolls. Since the roll is one continuous piece across the width, the overall temperature of the roll (and thus the total heat flux) will affect the bulk profile of the casting rolls. Therefore, to achieve an optimum profile with a smooth parabolic roll profile, a cold casting roll profile is selected based on the expected heat fluxes and other process parameters so that the heated shape of the casting rolls at the nip generates a desired thin metal strip thickness profile. However, due to the plurality of steel grades and strip thicknesses that are produced using any given pair of casting rolls (i.e., a roll set), there is no one single cold profile that will give the targeted hot shape under all conditions. Furthermore, there are inevitably local variations in heat flux due to variability in the roll surface, variations in the molten metal temperatures, variations in atmospheric conditions, etc. These local variations in heat flux are constantly changing and cannot be predicted and therefore cannot be taken into account when creating a cold roll profile. As a result, it is not uncommon to experience roll profile variations and deviations, resulting in unwanted ridges and valleys arranged along the roll profile.

Previous proposals for casting roll profile control have relied on mechanical devices to deform the casting roll; for example, by movement of deforming pistons or other elements within the casting roll or by applying bending forces to the support shafts of the casting rolls. However, these previous proposals for casting roll profile control have limitations. For example, Japanese Patent No. 2544459 (herein "JP '459") describes a casting roll with internal "water-cooled roll heating means embedded in the two end parts" used to control the deformation experienced at each roll end during casting. See, JP '459, Section: "Means employed in order to solve the problem." The casting rolls are solid metal rolls with internal cooling channels, which require water heating means at the end of the casting rolls. The limitations of the caster disclosed in JP '459 are discussed in U.S. Pat. No. 5,560,421 (herein "the '421 patent", which states that "the thermal capacitance of each drum 01 to be heated is large, a deformation responsibility of the shape of the outer surfaces of the drum to be controlled is low and it would be difficult or impossible to timely control the workpiece." '421 patent, col. 1, 11, 64-col. 2, 11, 1. The '421 patent continues to explain, "it would be impossible to suitably control the shape of the workpiece to be continuously cast." Id., col. 2, 11, 6-7. The '421 patent proposes a solution in which the solid casting rolls have end cutouts with large external annular elements (to the solid roll) heated by water. These annular elements are used to change the profile of the casting roll. '421 patent, col. 2, 11, 37-42. However, large solid casting rolls such as those proposed by JP '459 and the '421 patent are expensive to manufacture, have relatively short service life (due to the effects of thermal fatigue from the cyclic heat flux experienced during twin roll casting on larger cylinder masses), and are much less responsive due to their large thermal mass.

It has also been proposed to position expansion rings directly on a cylindrical tube, for example, of 80 millimeters thickness of copper and copper alloy, optionally with a coating of chromium or chromium alloy thereon, and having a plurality of longitudinal water flow passages extending through the tube to form casting rolls. This proposal was tried and was found not to be effective, since the heat provided to the expansion rings is transferred into the cylindrical tube. As a result, the rings were not effectively responsive to the heat to expand the cylindrical tube to commercially control the shape of the roll profile of the casting surfaces of the casting rolls. It is also noted that these solutions are arranged within each roll, which can be costly due to the complexities associated with each such solution.

It has also been proposed to use induction heating on other types of rollers, such as calendaring rolls in the papermaking arts. See, for example, U.S. Pat. Pub. 2007/0042884 ('884 publication). However, calendaring rolls are typically made of a ferrous material that is more responsive to induction heating. Also, calendaring rolls do not experience the extreme heat flux of molten metal casting rolls. Moreover, the '884 Publication reported that calendaring rolls having internal fluid paths for heating or cooling continuous across the entire width of a roll would render it impossible to effectively locally heat one portion of a roll.

In addition to more effectively altering casting roll profiles, there is also a desire to alter the casting surfaces at locations that may not be known in advance of assembling a casting system and casting, but only after the casting system assembled and casting has begun. These previously described systems provide for roll profile control at particular, pre-determined and fixed locations across the casting roll, unable to alter the roll profile at any particular location that may be desired without affecting the entire roll profile.

Accordingly, there remains a need for improved roll profile control that overcomes these previously identified limitations and those as further may be described herein.

SUMMARY

For continuous twin roll casting of thin metal strips, this disclosure describes methods, apparatus, and computer programs for controlling a roll profile of corresponding casting rolls by altering the localized temperature of said rolls.

In particular embodiments, a method of continuously casting thin strip comprises:

- providing a pair of internally cooled counter-rotatable casting rolls having casting surfaces laterally positioned to form a gap at a nip between the casting rolls through which a thin metal strip having a thickness of less than 3 mm can be cast, where the casting surface of each casting roll has a roll profile extending in an axial direction of the corresponding casting roll,
- providing a metal delivery system adapted to deliver molten metal above the nip to form a casting pool, the casting pool being supported on the casting surfaces of the pair of counter-rotatable casting rolls and confined at the ends of the casting rolls, delivering a molten steel to the metal delivery system;
- delivering the molten metal from metal delivery system above the nip to form the casting pool;
- counter rotating the pair of counter-rotatable casting rolls to form metal shells on the casting surfaces of the casting rolls that are brought together at the nip to deliver the thin metal strip downwardly, the thin metal strip having a thickness less than 3 mm and an initial thickness profile; and,
- altering a roll profile of at least one of the casting rolls by altering the temperature of the corresponding casting roll at any one or more local locations along a length of the corresponding casting roll.

Other embodiments provide an apparatus for continuously casting thin strip comprising:

- a pair of internally cooled counter-rotatable casting rolls having casting surfaces, the pair of casting rolls laterally positioned to form a gap at a nip between the casting rolls through which a thin metal strip having a thickness of less than 3 mm can be cast, where the casting surface of each casting roll has a roll profile extending in an axial direction of the corresponding casting roll;
- a metal delivery system adapted to deliver molten metal above the nip to form a casting pool, the casting pool being supported on the casting surfaces of the pair of counter-rotatable casting rolls and confined at the ends with a pair of side dams; and
- a temperature altering source external to the casting rolls and source having one or more zones configured to control a casting roll profile of at least one of the pair of casting rolls, where the temperature altering source is configured to alter a temperature of the corresponding casting roll at any one or more locations along a length of the corresponding casting roll, where the one or more zones of the temperature altering source are configured to locally heat and/or cool the corresponding casting roll.

Still other embodiments provide a computer program product as according to any variation described or contemplated herein. Yet other embodiments provide a method of altering a casting roll profile as described or contemplated herein. Still further other embodiments provide a thin metal strip formed in accordance with any process described or contemplated herein.

While a variety of different types of twin roll casting methods and apparatus having any of a variety of the same or different features may be employed, a commonality is the provision of a pair of counter-rotatable casting rolls having casting surfaces laterally positioned to form a gap at a nip between the casting rolls through which a thin metal strip is cast. While other thicknesses may be employed, in certain instances the casting rolls are configured to generate a thin metal strip having a thickness of less than 3 mm or less than 2 mm. The casting surface is an exterior or outer surface of the casting roll. The casting surface of each casting roll has a roll profile extending in a direction of the casting roll length, the casting roll length extending in an axial direction of the corresponding casting roll. The axial direction extends in a direction of the rotational axis or a direction parallel to the rotational axis of the corresponding casting roll. Accordingly, the roll profile generally extends the axial direction, but may deviate slightly from being perfectly parallel as may be desired to obtain a desired strip thickness profile or due to undesired variations that may arise from time-to-time. The roll profile (i.e., roll shape) can be described as the shape or contour of the casting surface, and may be measured relative to the rotational axis of the casting roll or relative to any other desired plane, for example. It is appreciated that the roll profile may form any desired shape. For example, it may be desired to have a roll profile that extends parallel to the casting roll rotational axis. It may also be desired, by additional example, to provide a slightly convex casting surface, which corresponds to a convex roll profile. Other shapes and variations may be desired for a variety of different reasons, but in the end, it is desirous to have the capability of generating any desired roll profile as may be desired for the casting surface of any casting roll. Improved capabilities for achieving different casting surface shapes, that is, different roll profiles, is discussed further herein.

Another commonality amongst twin roll casting methods is delivering molten metal above the nip, and the provision of a metal delivery system adapted to deliver molten metal above the nip to form a casting pool. As discussed previously, the casting pool is supported on the casting surfaces of the pair of counter-rotatable casting rolls and confined at the ends of the casting rolls by structure commonly referred to as side dams. While any of a variety of different end-constraining structures (i.e., side dams) may be employed, each having different features or designs, all such variations still achieve the general purpose of constraining the casting pool. In performing these methods, molten steel is delivered to the metal delivery system, and the molten metal delivered from metal delivery system above the nip to form the casting pool. It is appreciated that the molten metal employed in the methods, as with the resulting thin metal strip or sheet, may form any of a variety of steel alloys contemplated herein.

After forming the casting pool, the pair of counter-rotatable casting rolls counter rotate to form metal shells on the casting surfaces of the casting rolls that are brought together at the nip to deliver the thin metal strip downwardly. In certain instances the thin metal strip has a thickness less than 3 mm or less than 2 mm, although in other instances, other thicknesses may be formed. As mentioned previously, the thin metal strip can also be described as having a thickness profile. In instances when the methods include a manner for altering the thickness profile, whether to correct the profile or to otherwise change the profile for any other reason, a thin metal strip may be formed having a first or initial thickness profile and after altering, may then have a second or altered thickness profile.

During casting, the casting surface roll profile of at least one of the pair of counter-rotating casting rolls is altered by altering a temperature of the corresponding casting roll at any one or more local locations along a length of the corresponding casting roll. It is appreciated that a local location is a location that spans only a portion of the casting roll length, or more specifically, the casting surface length, which extends in the axial direction of the casting roll (that is, a direction parallel to the rotational axis of the casting roll) between opposing ends of the casting roll. In some embodiments, a local location may comprise 5 mm or more of the length of a casting roll, for example, 25-35 mm of the length of the casting roll. In altering the temperature locally, a local temperature change will occur to alter the shape of the casting surface and therefore, the roll profile. Whether there is one local location or a plurality of local locations where the roll profile has been altered, the roll profile has been altered and thereby controlled. It is appreciated that this local temperature change is a change relative to other local locations of the casting roll length. This contemplates that temperature changes may be implemented across the entire length of the casting roll, but one or more local locations observe greater or less temperature change than other local locations along the length of the casting roll. It is appreciated that the heating or cooling occurring at these local locations may be focused along the casting surface or a portion of the roll below the casting surface (meaning, along any portion of the casting roll thickness).

Altering the temperature connotes generating an increase in temperature by the transfer of heat to or from the casting roll. Therefore, it is contemplated that temperature changes may be imparted by a heat source or a cooling source. It follows that a temperature altering source may form or include a heat source and/or a cooling source, contemplating that heating and/or cooling may be occurring at different locations along the length of the casting roll. The temperature altering source may also be referred to as a heat altering source, as it alters the heat contained within the casting roll. In particular instances, the location of the temperature altering source is arranged in spaced relation from a corresponding casting roll in sufficient proximity to the associated casting surface. When the temperature altering source is located externally from the casting roll, the temperature altering source may be located at any location about the circumference of the casting roll—circumferentially between the exit side of the nip and the casting pool. When the temperature altering source is located internally within the casting roll, the temperature altering source may be located at any location about the circumference of the casting roll—and may be located opposite the casting pool and just before or at the nip, for example.

In particular instances, the temperature altering source, or any heat or cooling source, has one or a plurality of zones configured to locally heat and/or cool the corresponding casting roll, where each of the one or more zones of the temperature altering source corresponds with one of the one or more locations of the corresponding casting surface. It is appreciated that a single temperature altering source may be provided to alter the temperature of a single zone or a plurality of zones. Conversely, it is contemplated that multiple temperature altering sources may be employed to alter different zones when multiple zones are to be altered along the length of the casting roll. While the width of each zone may be selected as desired to provide the ability to sufficiently adjust the roll profile locally. For example, each of the one or more zones has a zone width greater than or equal to 5 millimeters or 10 millimeters. In addition to zone width, a zone may also have a particular length extending generally in the circumferential direction of the casting roll. It may be that the longer the zone length and/or the wider the zone width, a lower power of heat may be needed to sufficiently heat (or cool) the roll to obtain the desired alteration to the roll profile. It is appreciated that the temperature altering source can be placed externally anywhere around the circumference of a casting roll, between the exit side of the nip and the casting pool, but may have the greatest effect if placed immediately prior to the casting pool. In other variations, it is contemplated that the temperature altering source may be arranged internally within each casting roll at any location 360 degrees around the roll, but it may have the greatest impact when arranged opposite the casting pool prior to or opposite the nip.

It is appreciated that a heat source may form any suitable heat source, that is, any heat source that may be implemented for use for the purposes described herein for altering the temperature of a casting roll. For example, in certain embodiments, the heat source is selected from a group consisting of a laser or an array of lasers, a focused scanning laser, an electrical radiation source, a gas burning radiation tube, an induction heating source, and a direct flame impingement source. With regard to the laser array, in one example, the array of lasers comprises a diode laser array or a vertical-cavity surface emitting laser array. It is appreciated that any desired amount of heat input or heat input rate may be employed as desired for a particular implementation. In one example, the heat input is 0.1 to 10 megawatt per square meter (MW/in). A scanning laser could use higher power, but should be kept below the 10 $MW/m^2$ if averaged over time in any one zone to prevent damage to the roll.

As noted above, in certain instances the heating source is an induction heating source. An inductor creates an alternating magnetic field using an electrically conductive winding, which may form of a copper wire or the like. The winding may be water cooled. The changing magnetic field induces eddy currents within the casting roll, which thereby generate a heat input by Joule heating. The amount of heat generated within the casting roll depends on the metals used to form the casting rolls and on the magnitude, frequency, and spatial distribution of the magnetic fields flowing through the casting roll. An advantage of induction heating is that the power heating the casting roll is distributed over a thickness of the casting roll below but near the casting (exterior) surface. This size of this thickness may be controlled by the frequency of the magnetic field. At higher frequencies the eddy currents are located closer to the surface. The skin depth of the electric field may also be controlled by controlling composition of the metals at the surface of the casting rolls. For example, chromium plating or nickel plating may reduce skin depth of otherwise copper and copper alloy rolls and improve heating efficiency. Accordingly, altering the casting roll profile by thermal expansion can be attained at a lower casting surface temperature as compared to the other methods. By virtue of using induction heating, a reduction in thermal damages along the casting surface may be achieved.

In certain instances when the heating source is an induction heating source, the heating source comprises a plurality of inductors arranged in an array along the length of each corresponding casting roll. To alter the heat transfer to the adjacent casting roll, power to each of the one or more individual inductors is variably provided to provide a desired amount of heat. One or more transformers may be employed to provide the alternating current supplied to the inductors. In other instances, in lieu of providing an array of inductors, an induction heating source comprises one or more transformers placed near the roll edge(s), each with one or more windings extending therefrom and being operably connected thereto (in operable communication). One or more transformers may be employed to supply alternating current to each winding. Each winding is electrically conductive, and as such, may be formed by any electrically conductive member (structure), such as a wire, hollow tube, or the like. Each may be formed of any electrically conductive material, such as copper. The tube may form any desired cross-section, such as circular, ellipsoidal, or rectangular. In the hollow of the tube, a coolant, such as water, may optionally be arranged for the purpose of cooling the winding. Each winding also extends along a length of a corresponding casting roll, the length being the full or partial length of the casting roll. The application of heat generated by the inductive heating source may be controlled by moving the winding closer to and/or further away from the casting roll. While not necessary, in certain instances the winding is arranged parallel to the roll rotational axis, and in some embodiments containing one or more moveable cores placed along the length of the windings. Each core extends across one or more windings, partially or fully, such that the continuous winding is arranged between each core and the corresponding casting roll. It is appreciated that each of the one or more zones are defined by one or more of the ferromagnetic cores. An alternating current (AC) is applied to this continuous winding to generate an electromagnetic flux to generate and apply the desired heat input for a casting roll. The application of heat generated by the inductive heating source may be controlled by moving each of the individual cores closer to and/or further away from the continuous winding, between retracted and extended arrangements, thereby controlling the location of the magnetic field and induced eddy currents relative to the roll. When the magnetic field and induced eddy currents extend further into the casting roll, heat transfer into the roll is increased. Optionally, to provide added flexibility in controlling roll profile, each of the cores are configured to translate along the continuous winding, generally in an axial direction of the casting roll, for at least a portion of the common length.

Since each ferromagnetic core has a very high permeability as compared to air, the magnetic field in the surrounding of the winding is mainly guided inside the ferromagnetic core. At the pole faces, the magnetic field lines flow orthogonal from the face into the other media and moves to the opposite magnetic pole face. Depending on the position of the core, we can distinguish between two arrangements.

In the first arrangement, when the ferromagnetic core and the continuous winding (pole faces) are in a retracted arrangement, the ferromagnetic core and continuous winding (pole faces) are located a sufficient distance from the casting roll such that no heat is applied to the casting roll. In this arrangement, the core and conduit (pole faces) are located a distance greater than the distance between positive (+) and negative (−) pole faces. As a result, the magnetic circuit (B field) is closed through the magnetic field lines extending through the air between the core and the casting roll. Very little current occurs because the electrical conductivity of air is sufficiently low.

In the second arrangement, where the ferromagnetic core and the continuous winding (pole faces) are in an extended arrangement, the ferromagnetic core and continuous winding (pole faces) are located sufficiently close to the casting roll to apply heat thereto. In such instances, the core and conduit (pole faces) are located a distance sufficiently less than the distance between positive (+) and negative (−) pole faces. As a result, the B magnetic field lines mainly flow inside the casting roll close to the casting surface. The electrical conductivity of the casting roll is high, and consequently an AC current is created. By regulation of the gap between the roll surface and the core and pole faces, a variation of the local power is possible.

In instances when the temperature altering source is or includes a cooling source, it is contemplated that any suitable cooling source may be employed. In one example, in certain embodiments the cooling source utilizes cryogenic gas, and may be applied using a discharge nozzle or the like.

In altering the roll profile, in certain instances, a need is determined for altering the roll profile of at least one casting roll of the pair of counter-rotating casting rolls. Such determinations may be made by measuring and evaluating the any parameter, such as the as-cast thickness profile of a thin metal strip and/or the roll profile of a casting roll itself. The determination may also be based upon measurement and evaluation of the temperature of the cast strip at any one or more locations across the width of the cast strip. It may be that the temperature is measured across a width of the strip, resulting in a measured cross-width temperature distribution of the cast strip. In particular instances, the strip temperature measured is the surface temperature of the cast strip. These determinations may be performed while the strip is being cast or after casting of a strip is complete. The determination may also be based upon measurement and evaluation of the casting roll temperature at any one or more locations across the length of the casting roll. Such measurements may be taken: along the casting surface of the casting roll (which is generally cylindrical exterior side surface); within a thickness of the casting roll, such as by use of embedded sensors; internally along a backside of a thickness of the casting roll.

It is appreciated that evaluating any measured parameter may be performed using any sensing devices capable of measuring any parameter useful in determining the cast strip thickness profile, the roll profile, or the strip temperature. For example, a plurality of sensors may be employed to measure a plurality of thicknesses across a width of the strip or casting roll. By further example, a plurality of sensors may be employed to measure a distance between each sensor and a casting roll or strip. When employing the plurality of sensors to measure distances between each sensor and the strip, this occurs on opposing sides of the strip to obtain the thickness profile. In other variations, one or more sensors may be employed to measure the thickness or thickness profile of the cast strip, such as by use of an x-ray gauge, for example. In yet another example, a plurality of sensors may be employed to measure a plurality of temperatures of the strip across a width of the strip to generate a cross-width temperature distribution. Other techniques for determining the strip thickness profile may be employed as is known by one of ordinary skill.

When employed, each sensor generates a signal response as a function of a parameter, such as a distance, thickness, or temperature, useful for determining the thickness profile or the roll profile as described above. The signal response may be represented by a value, which may represent current, voltage, resistance, or any other characteristic of the signal response. Ultimately, the signal is sent to a programmable logic controller for evaluation and processing, where the controller interprets the received signal. Without limitation, the signal may also be sent: by wireless communication to the controller, such as without limitation by infrared signal or radio frequency; by one or more cables, including without limitation fiber optics; or any other method or means known to those having ordinary skill in the art.

A controller includes a logic processor, such as a microprocessor, and a memory storage device. The memory storage device may comprise any desired memory storage device, such as RAM (random access memory), ROM (read-only memory), and PROM (programmable read-only memory), which may take any desired form, such as hard disk drives, optical storage devices, flash memory, and the like. An operator may utilize a user-interface to monitor the sensor measurements and to program or otherwise control or instruct the operation of the controller and optionally a twin roll caster, which includes performing each step and method described herein. The user-interface and the controller may communicate by way of I/O cable, wireless communication, or any other known means.

A controller may be programmed by any known graphical or text language. Programmed instructions, data, input, and output may be stored in a memory storage device, which is accessible to the processor. Particularly, programmed instructions for performing the different methods described herein may be stored in the memory storage device and executed by the processor. The processor executes these programmed instructions and performs the assessment of the thickness profile and roll profile, and determines whether the thickness profile needs altered. The memory storage device also stores inputs, outputs, and other information, such as, for example, functions and tables representing signal response curves for use by processor in performing its operations.

While various instructions may be stored and executed to perform the methods described herein, exemplary instructions include:

receiving instructions for receiving a signal from a sensor, the sensor sensing a measured parameter for determining a need to alter the roll profile of at least one casting roll of the pair of counter-rotating casting rolls, the signal being received from one or more locations along a width of the thin metal strip or along a length of at least one of the pair of casting rolls, the signal being generated by the sensor as a function of a measured parameter (e.g., distance, thickness, or temperature) associated with the roll profile, a temperature of the thin metal strip or casting roll, or of a thickness or thickness profile of the thin metal strip;

interpreting instructions for interpreting the sensor signal as a measured parameter associated with the roll profile, temperature of the thin metal strip or casting roll, or strip thickness or thickness profile; and, altering instructions for altering a temperature of the corresponding casting roll at any one or more local locations along a length of the corresponding casting roll.

Additional instructions, which may be optional, include:

determining instructions for determining a need to alter the roll profile of at least one casting roll of the pair of counter-rotating casting rolls based upon the sensor output signal; and, altering instructions for altering the roll profile of at least one of the pair of counter-rotating casting rolls by altering a temperature of the corresponding casting roll at any one or more local locations along a length of the corresponding casting roll using the temperature altering source.

Additional instructions may be employed to implement and perform the various methods and operations described herein. All instructions as described herein or as may be formulated to perform any method or operation described herein may be assembled to form a computer program product.

After it has been determined that it is desirous to alter the roll profile, the roll profile of at least one of the pair of counter-rotating casting rolls is achieved by altering a temperature of the corresponding casting roll at any one or more local locations along a length of the corresponding casting roll. Temperature alteration may be achieved in any manner described herein with use of a temperature altering source. Subsequent to altering the roll profile of at least one of the pair of counter-rotating casting rolls, the pair of counter-rotatable casting rolls counter rotate to form metal shells on the casting surfaces of the casting rolls that are brought together at the nip to deliver the thin metal strip downwardly, the thin metal strip having a thickness less than 3 mm and an altered thickness profile, the altered thickness profile being different than the initial thickness profile.

DETAILED DESCRIPTION

Described herein are methods for continuously casting thin metal strip with improved roll profile control. Generally, continuous thin strip casting includes a pair of counter-rotatable rolls upon which a pool of molten metal is provided. This pool is referred to as a casting pool. At the bottom of the casting pool, a gap is formed between the pair of counter-rotatable rolls. This gap is referred to as a nip. With the pair of counter-rotatable rolls being cooled, as the rolls rotate through the casting pool, molten metal in contact with each roll is rapidly cooled to solidify along the roll. This process continues until a thin metal strip is downwardly discharged (delivered) from the nip for cooling and any additional processing that may be desired. Upon inspection, the resulting as-cast thin metal strip thickness and its thickness profile may not be shaped or sized as was intended. In response, to alter the as-cast strip thickness shape, it may not only be desirous to alter the casting roll arrangement, but also to alter the size and/or shape of one or both casting rolls. In doing so, the roll profile of the outer, casting surface of each casting roll is altered. This disclosure describes improved methods and apparatuses for better altering or controlling casting roll profile, and as a result altering or controlling the strip thickness and its thickness profile.

Figure 1:
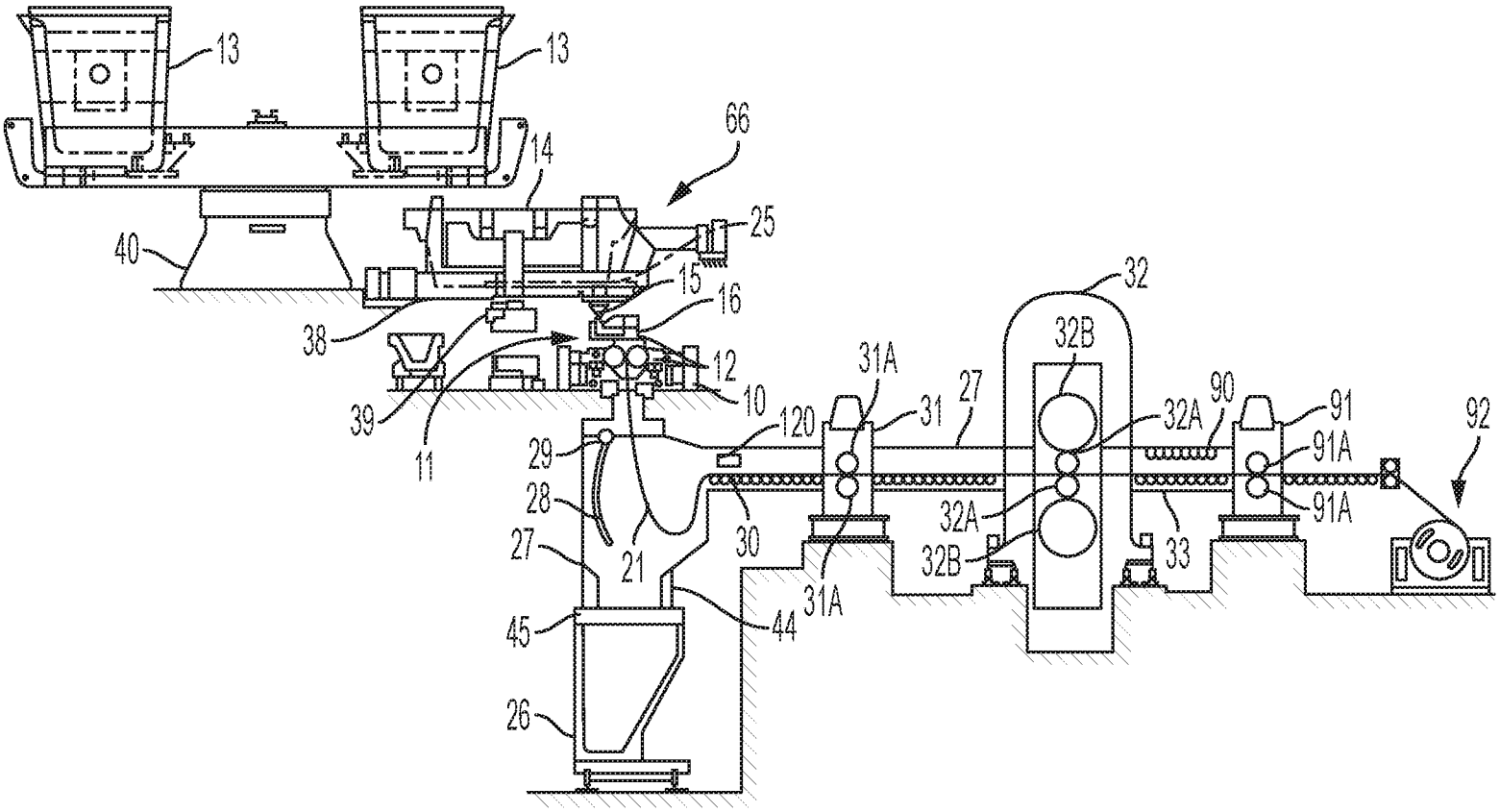
FIG. 1 is a diagrammatical side view of a twin roll caster system/plant in accordance with one or more aspects of the present invention.
Figure 2:
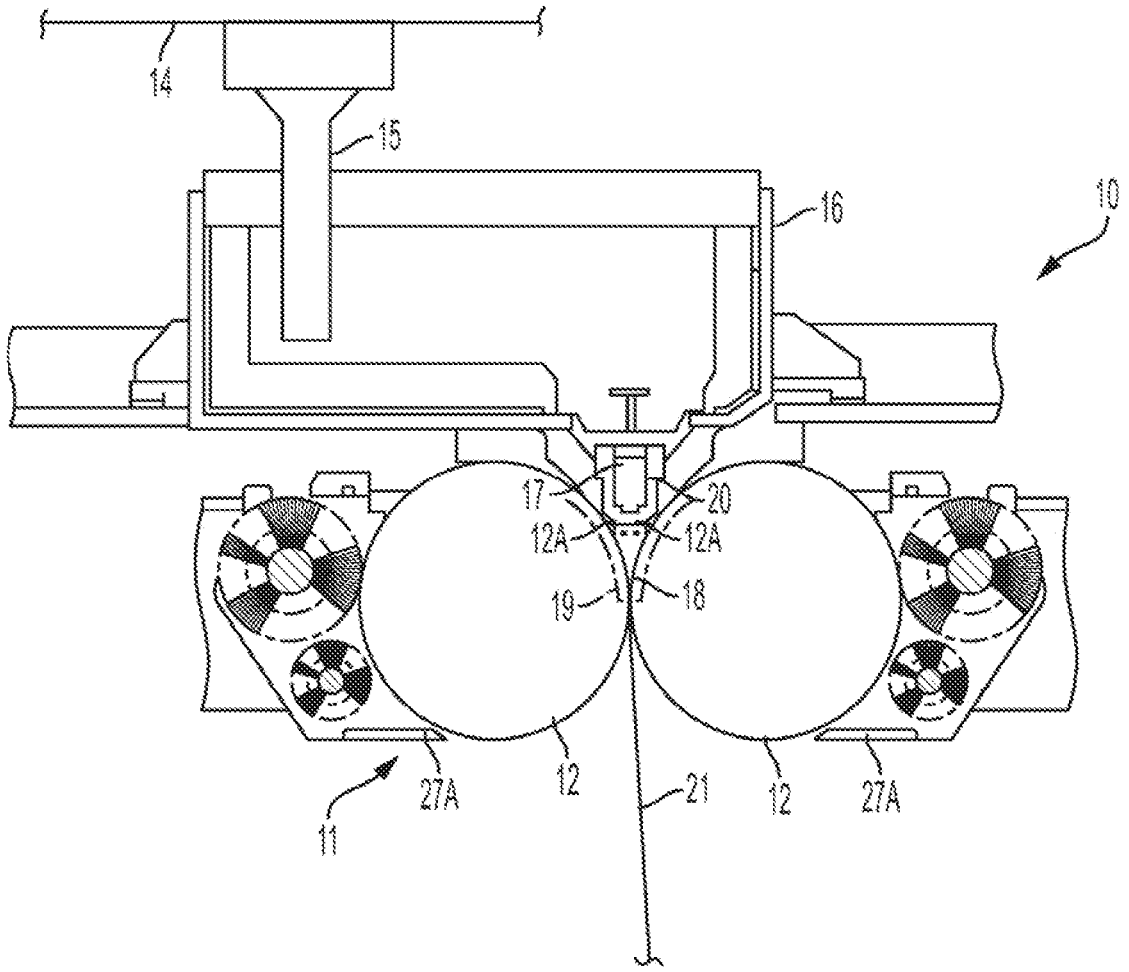
FIG. 2 is a partial side-sectional view through the casting rolls mounted in a roll cassette in the casting position of the caster of FIG. 1, in accordance with one or more aspects of the present invention.

In one example, with reference to FIGS. 1 and 2, an exemplary strip casting system is shown. In this embodiment, the strip casting system is a continuous twin roll casting system. The twin roll caster comprises a main machine frame 10 that that stands up from the factory floor and supports a roll cassette module 11 including a pair of counter-rotatable casting rolls 12 mounted therein. The casting rolls 12 having casting surfaces 12A are laterally positioned to form a nip 18 there between. Molten metal is supplied from a ladle 13 through a metal delivery system, which includes a movable tundish 14 and a transition piece or distributor 16. From the distributor 16, molten metal flows to at least one metal delivery nozzle 17 (also referred to as a core nozzle) positioned between the casting rolls 12 above the nip 18. Molten metal discharged from the delivery nozzle 17 forms a casting pool 19 of molten metal supported on the casting surfaces 12A of the casting rolls 12 above the nip 18. This casting pool 19 is laterally confined in the casting area at the ends of the casting rolls 12 by a pair of side closures or plate side dams 20 (shown in dotted line in FIG. 2). The upper surface of the casting pool 19 (generally referred to as the "meniscus" level) typically rises above the bottom portion of the delivery nozzle 17 so that the lower part of the delivery nozzle 17 is immersed in the casting pool 19. The casting area above the casting pool 19 provides the addition of a protective atmosphere to inhibit oxidation of the molten metal before casting.

The ladle 13 typically is of a conventional construction supported on a rotating turret 40. For metal delivery, the ladle 13 is positioned above a movable tundish 14 in the casting position as shown in FIG. 1 to deliver molten metal to movable tundish 14. The movable tundish 14 may be positioned on a tundish car 66 capable of transferring the tundish from a heating station (not shown), where the tundish is heated to near a casting temperature, to the casting position. A tundish guide, such as rails, may be positioned beneath the tundish car 66 to enable moving the movable tundish 14 from the heating station to the casting position. An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

With reference to FIG. 2, the casting rolls 12 are internally water cooled so that as the casting rolls 12 are counter-rotated, shells solidify on the casting surfaces 12A as the casting rolls move into and through the casting pool 19 with each revolution of the casting rolls 12. Internal cooling may be accomplished with longitudinal cooling passages. The shells are brought together at the nip 18 between the casting rolls 12 to produce solidified thin cast strip product 21 delivered downwardly from the nip 18. The gap between the casting rolls is such as to maintain separation between the solidified shells at the nip and form a semi-solid metal in the space between the shells through the nip, and is, at least in part, subsequently solidified between the solidified shells within the cast strip below the nip. In one embodiment, the casting rolls 12 may be configured to provide a gap at the nip 18 through which thin cast strip 21 less than 3 mm or less than 2 mm in thickness can be cast, for example. Counter rotating the casting rolls 12 to form metal shells on the casting surfaces 12A of the casting rolls 12 may occur, for example, at a heat flux greater than 10 $MW/m^2$.

With continued reference to FIG. 1, at the start of the casting campaign, a short length of imperfect strip is typically produced as casting conditions stabilize. After continuous casting is established, the casting rolls 12 are moved apart slightly and then brought together again to cause the leading end of the thin strip to break away forming a clean head end for the following strip to cast. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the strip 21 onto the guide table 30 and feed the strip 21 through the pinch roll stand 31. The apron 28 is then retracted back to the hanging position to allow the strip 21 to hang in a loop beneath the casting rolls in enclosure 27 before the strip passes to the guide table 30 where it engages a succession of guide rollers.

One or more sensors 120 are shown arranged along guide table 30 for measuring and/or evaluating the thickness and/or thickness profile of the thin metal strip 21, or any other desired parameter. As discussed previously, sensors 120 may be configured to measure at a particular location any desired parameter useful for determining the as-cast thickness profile of the strip 21, such the strip thickness or temperature, for example. It is appreciated that the sensors 120 may be arranged at other locations between the nip 18 and the first pinch roll stand 31. In other variations, sensors 120 may also be arranged adjacent to each of the casting rolls 12, as with temperature altering sources 100 (see FIG. 3), for the purpose of measuring the roll profile of a corresponding casting roll 12 to determine whether any deviation is present.

The sealed enclosure 27 is formed by a number of separate wall sections that fit together with seal connections to form a continuous enclosure that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal", "sealed", "sealing", and "sealingly" in reference to the scrap receptacle 26, enclosure 27, and related features may not be completely sealed so as to prevent atmospheric leakage, but rather may provide a less than perfect seal appropriate to allow control and support of the atmosphere within the enclosure as desired with some tolerable leakage.

With continued reference to FIG. 1, a rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. When scaled, the enclosure 27 and scrap receptacle 26 are filled with a desired gas, such as nitrogen, to reduce the amount of oxygen in the enclosure and provide a protective atmosphere for the strip 21.

With reference now to both FIGS. 1 and 2, the enclosure 27 may include an upper collar portion 27A supporting a protective atmosphere immediately beneath the casting rolls in the casting position. When the casting rolls 12 are in the casting position, the upper collar portion is moved to the extended position closing the space between a housing portion adjacent the casting rolls 12, as shown in FIG. 2, and the enclosure 27. The upper collar portion may be provided within or adjacent the enclosure 27 and adjacent the casting rolls, and may be moved by a plurality of actuators (not shown) such as servo-mechanisms, hydraulic mechanisms, pneumatic mechanisms, and rotating actuators.

After the thin metal strip or sheet is formed (cast), the strip is hot rolled and cooled to form a desired thin metal strip or sheet having desired microstructure and material properties. After hot rolling, any heat treatment may also be employed.

Exemplary hot rolling and cooling may be performed in any desired manner. For example, referring again to the exemplary embodiment shown in FIG. 1, a thin cast steel strip 21 is shown passing from the casting rolls after formation/casting and across guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The work rolls 32A have work surfaces relating to the desired strip profile across the work rolls. It is appreciated that one pair or multiple pairs of work rolls may be employed. Work rolls and rolling mills are distinguishable from pinch rolls, where a pair of work rolls apply sufficient forces to more substantially reduce the thickness of the strip while pinch rolls are employed to "grip" the strip to impart tension to control the translation of the strip. Much lower forces are applied to the strip by way of pinch rolls, and while these forces may still reduce the thickness of the strip, this reduction is substantially less than the reduction generated by work rolls.

After exiting the hot rolling mill 32, the hot rolled cast strip then passes onto a run-out table 33, where the strip may be cooled by contact with a coolant, such as water, supplied via water jets 90 or other suitable means, and by convection and radiation. In particular instances such as shown, the hot rolled strip may then pass through a second pinch roll stand 91 having rollers 91A to provide tension on the strip, and then to a coiler 92. The thickness of strip may be between about 0.3 and about 3 millimeters in thickness after hot rolling in certain instances, while other thicknesses may be provided as desired.

The strip 21 is passed through the hot mill to reduce the as-cast thickness before the strip 21 is cooled. In particular instances, the hot solidified strip (the cast strip) may be passed through the hot mill while at an entry temperature greater than 1050° C., and in certain instances up to 1150° C. After the strip 21 exits the hot mill 32, the strip 21 is cooled such as, in certain exemplary instances, to a temperature at which the austenite in the steel transforms to martensite by cooling to a temperature equal to or less than the martensite start transformation temperature Ms. In certain instances, this temperature is ≤600° C., where the martensite start transformation temperature $M_S$ is dependent on the particular composition. Cooling may be achieved by any known methods using any known mechanism(s), including those described above. In certain instances, the cooling is sufficiently rapid to avoid the onset of appreciable ferrite, which is also influenced by composition. In such instances, for example, the cooling is configured to reduce the temperature of the strip 21 at the rate of about 100° C. to 200° C. per second.

Figure 3:
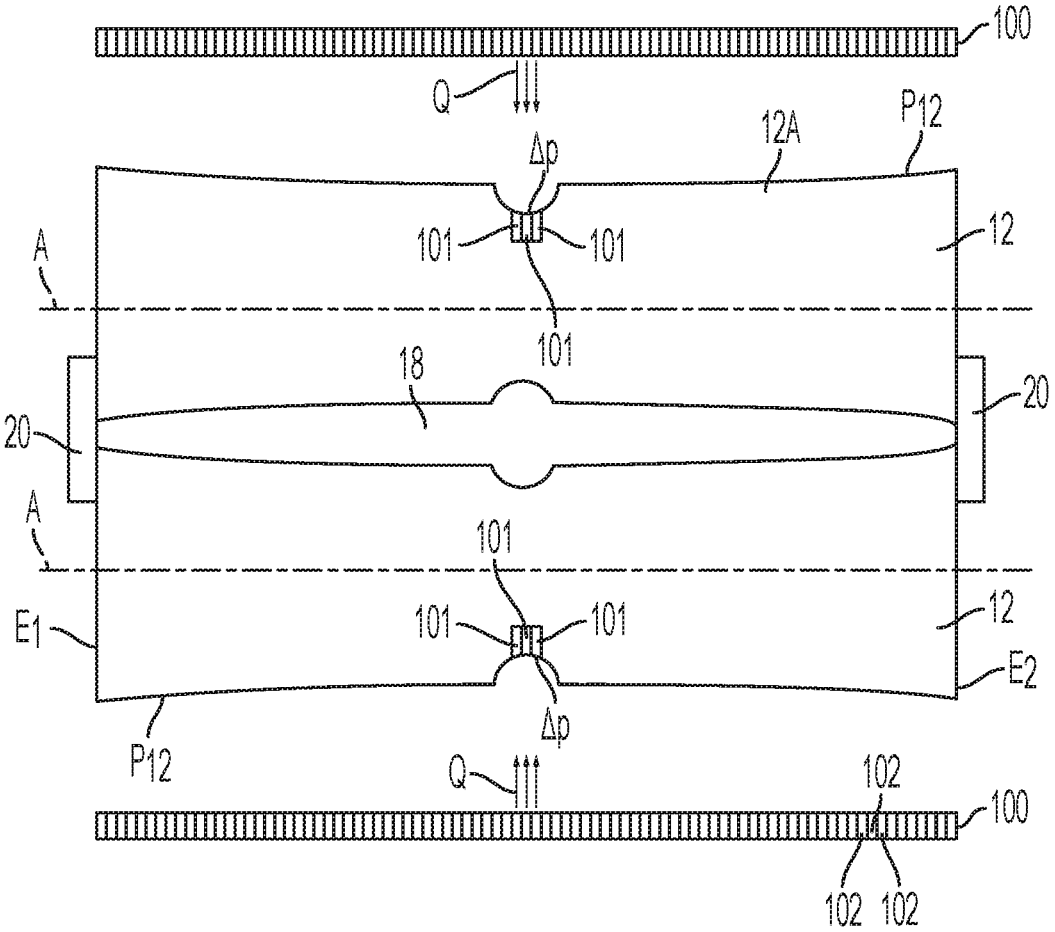
FIG. 3 is a top view of the pair of casting rolls and nip from FIG. 2, the nip forming a gap between the casting rolls through which a sheet of metal is cast, where a temperature altering source is arranged adjacent each of the casting rolls, the casting rolls each having a generally concave roll profile and a local deviation (i.e., non-conformity) in the roll profile to which heat is being applied by the temperature altering source to expand and thereby correct the deviation.
Figure 4:
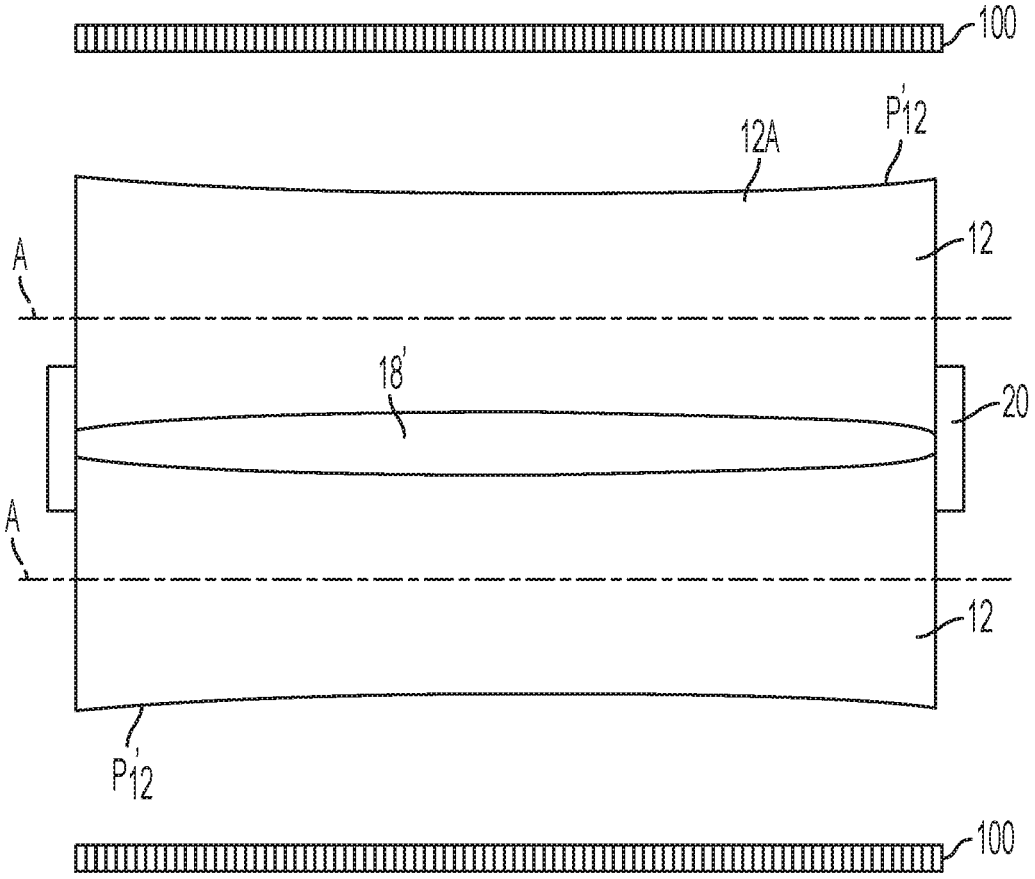
FIG. 4 is a top view of the pair of casting rolls and nip from FIG. 3, where the temperature altering source has corrected the local roll profile deviation.
Figure 5:
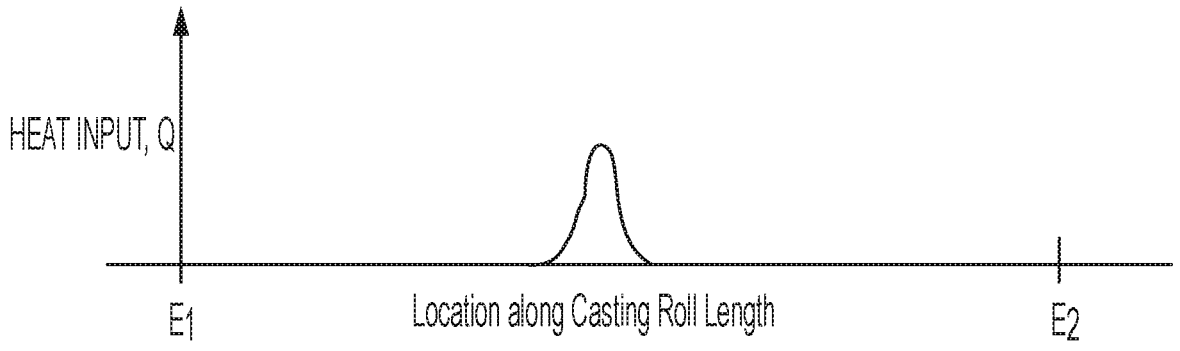
FIG. 5 is a chart showing the local application of heat input (Q) along the length of the casting roll as performed in FIG. 3.

With reference now to FIG. 3 a temperature altering source 100, such as a heating source, is shown arranged adjacent each of the casting rolls 12. Each casting roll has a generally concave roll profile $P_{12}$ and a local deviation $\Delta_P$ (i.e., non-conformity) in the roll profile $P_{12}$ to which heat Q is being applied by the temperature altering source 100 to expand and thereby correct the deviation. The result of this heat expansion is elimination of the deviation $\Delta_P$, as is shown in FIG. 4, where nip 18' has an altered shape due to the changes made to casting roll profiles $P_{12}'$. Temperature altering source 100 includes a plurality of zones 102, which selectively discharge heat Q, permitting the application of heat Q only to the local locations 101 including the local deviation $\Delta_P$. This variable application of heat Q along the roll length is shown in the chart of FIG. 5. It is appreciated that the temperature altering source 100 may form any desired heating source or cooling source contemplated herein.

For example, in some embodiments, the temperature altering source 100 may comprise a plurality of laser diode array units. Each laser diode array unit may be individually driven or controllable to generate 0-2 kW of light energy output, thereby comprising a zone 102 of the temperature altering source 100. The invention is not necessarily limited to this range, and higher powered laser diode array units may be employed. In some embodiments, the temperature altering source is located such that each laser diode array unit directs light radiation on a local location 25-35 mm wide in a longitudinal direction of the casting roll. In some embodiments, the height of the local location is 75 mm about a circumference of the casting roll. As the casting roll rotates, the entire circumference of the casting roll may be locally heated or cooled.

Figure 6:
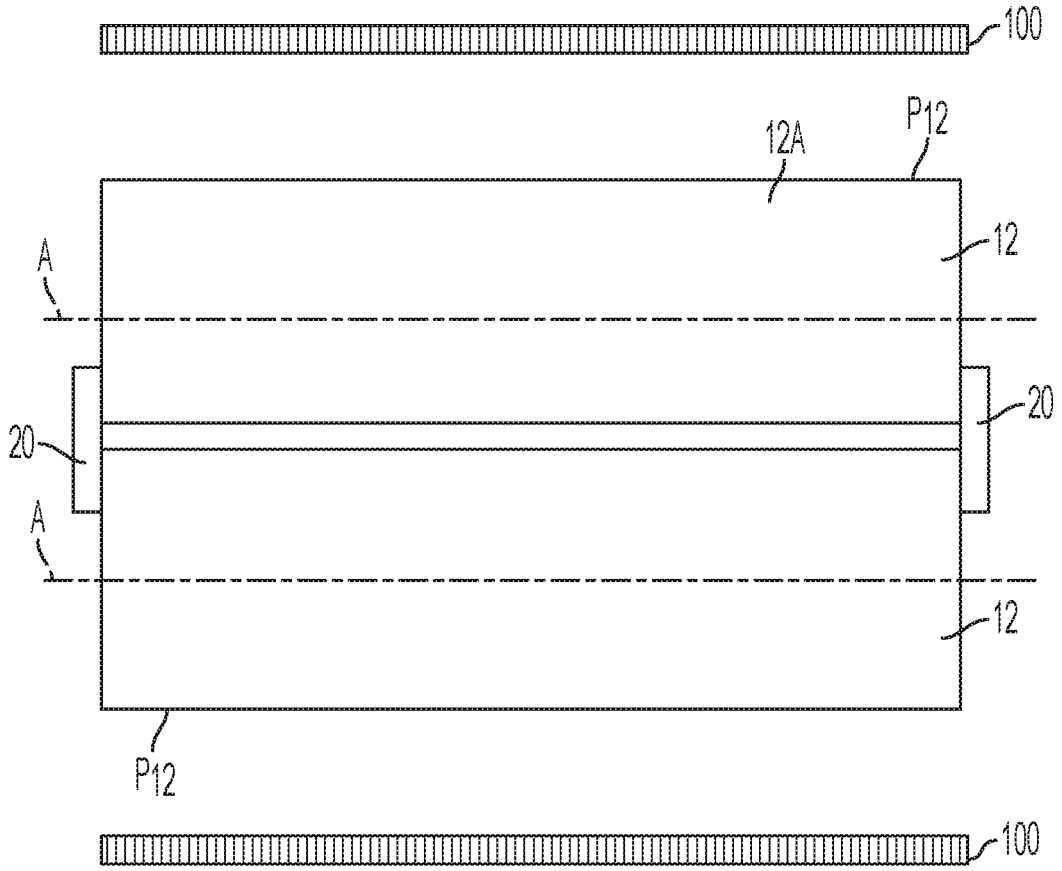
FIG. 6 is a top view of the pair of casting rolls and nip from FIG. 2, the nip forming a gap between the casting rolls through which a sheet of metal is cast, where a temperature altering source is arranged adjacent each of the casting rolls, the casting roll having a linear roll profile associated with a cylindrically-shaped casting rolls.
Figure 7:
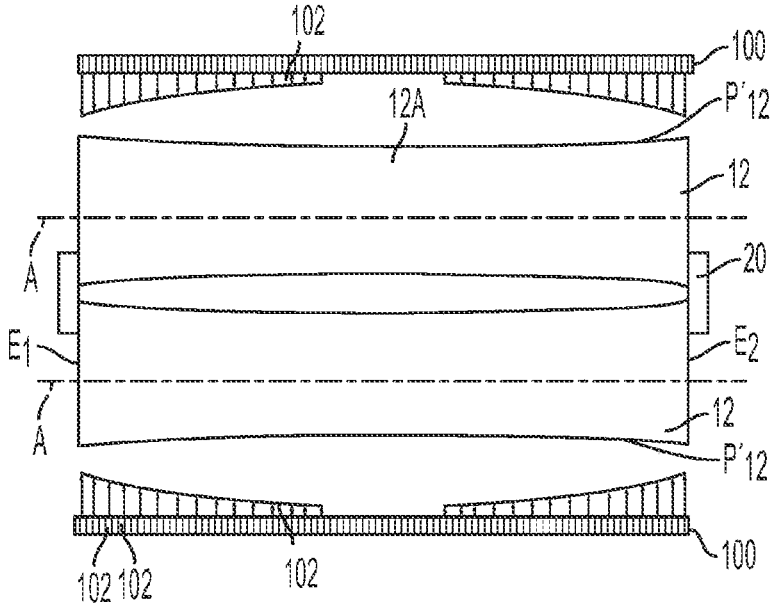
FIG. 7 is a top view of the pair of casting rolls and nip from FIG. 6, where the temperature altering sources generate a variable output of heat to increasingly expand the casting roll closer to each end of the casting roll length, thereby providing a concave roll profile.
Figure 8:
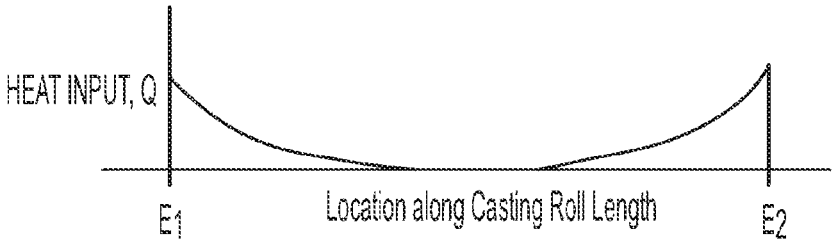
FIG. 8 is a chart showing the variable application of heat input (Q) along the length of the casting roll as performed in FIG. 7.

In another example, with reference to FIG. 6, a pair of casting rolls 12 is shown having roll profiles $P_{12}$ where the roll profile is too small, that which provides a substantially linear roll profile $P_{12}$ and results in a substantially cylindrical casting surface 12A. While any roll profile $P_{12}$ may be desired, in this instance, it is desired to provide a concave profile $P_{12}$. With reference now to FIG. 7, the concave profile $P_{12}$ is achieved by way of the temperature altering source 100 applying heat Q variably along the length of the casting roll 12 by way of selective and variable use of each zone 102, and more specifically, by applying more heat nearest the edges of the casting roll length, which are located at the lengthwise ends $E_1$, $E_2$ of the casting roll 12. The application of heat Q gradually diminishes as the temperature altering source 100 approaches the center of the casting roll length. As a result, greater roll expansion occurs closest to the roll ends $E_1$, $E_2$ and least in the center of each roll 12. With reference to FIG. 8, a chart shows the variable application of heat input Q along the length of the casting roll 12 consistent with the arrangement shown in FIG. 7. In lieu of the temperature altering source 100 operating as heat source in this instance, the source 100 could have operated as a cooling source. In such an instance, to achieve the concave roll profile $P_{12}$, the bulk of the cooling would occur centrally along the casting roll length, diminishing as the temperature altering source 100 more closely approaches each roll end $E_1$, $E_2$.

Figure 9:
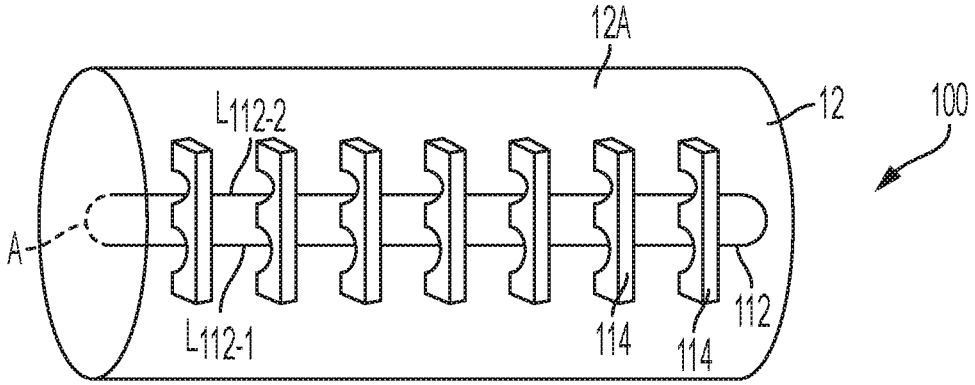
FIG. 9 is a rear perspective view of a casting roll with a temperature altering source arranged along the length of the roll, the temperature altering source being an induction heat source.

In yet another example, with reference to FIG. 9, the temperature altering source 100 is an induction heat source. In this instance, the induction heat source 100 forms a single turn inductor including a single continuous winding (i.e., coil) 112 extends to run the substantial length of the roll 12 and back. Winding 112 can be described as having a first length $L_{112\text{-}1}$ and a second length $L_{112\text{-}2}$, each of which overlap each along a common length of the casting roll 12. Along the winding 112, a plurality of ferromagnetic cores 114 are arranged, with each of the first and second winding lengths $L_{112\text{-}1}$, $L_{112\text{-}2}$ extending between each core 114 and the casting roll 12. Winding 112 is arranged at a particular distance to the casting roll 12, such that the movement of cores 114 towards or away from the casting roll 12 controls the input of heat into the casting roll 12 by induction.

Figure 10A:
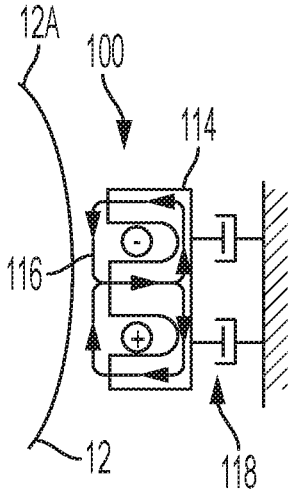
FIG. 10A is a side view of the induction heat source shown in FIG. 9 showing a core in a retracted arrangement whereby heat is not being applied to the casting roll.
Figure 10B:
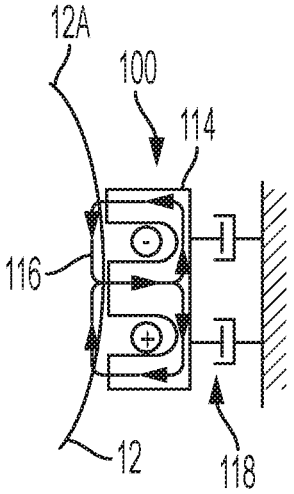
FIG. 10B is a side view of the induction heat source shown in FIG. 9 showing the cores in an extended arrangement whereby heat is being applied to the casting roll.

With reference now to FIGS. 10A and 10B, showing operation of the cores.

In FIG. 10A, a core 114 is shown in a retracted position where heat is not being applied to the casting roll 12. In this arrangement, articulating mechanism(s) 118 position the ferromagnetic core 114 and the positive (+) and negative (−) pole faces of continuous winding 112 a sufficient distance from the casting roll 12 such that no heat is applied to the casting roll. In this arrangement, the core 114 and pole faces of winding 112 are located a distance greater than the distance between positive (+) and negative (−) pole faces. As a result, the magnetic field circuit (B field) 116 is closed with the magnetic field lines 116 extending through the air between the core 114 and the casting roll 12. No current occurs because the electrical conductivity of air is sufficiently low. It is appreciated that articulating mechanism(s) 118 may form any structure that may manually or automatically alter the position of the ferromagnetic core 114 and winding 112 with positive and negative faces relative to the casting roll 12.

In FIG. 10B, the core 114 is shown in an extended arrangement, where heat is being applied to the casting roll 12. In this arrangement, articulating mechanism(s) 118 position the ferromagnetic core 114 and the positive (+) and negative (−) pole faces of continuous winding 112 sufficiently close to the casting roll 12 to apply heat thereto. In such instances, the core 114 and positive (+) and negative (−) pole faces of continuous winding 112 are located a distance sufficiently less than the distance between positive (+) and negative (−) pole faces. As a result, the B field lines mainly flow inside the casting roll 12 close to the casting surface 12A. The electrical conductivity of the casting roll is high, and consequently an AC current is created. By regulation of the gap between the roll surface 12A and the core and pole faces, a variation of the local power is possible. The method works until the saturation magnetization is reached. It is noted that in this case, the winding 112 is configured to generate heat below the casting surface 12A of the roll 12 (that is, below the exterior surface of the roll) by virtue of the core 114 moving closer to the casting roll 12 so to locate the magnetic field and eddy currents generated through the core 114 via winding 112 within a thickness of the casting roll 12. It is noted that heat applied below the surface 12A will permeate by heat transfer to also heat the casting surface 12A.

Figure 11:
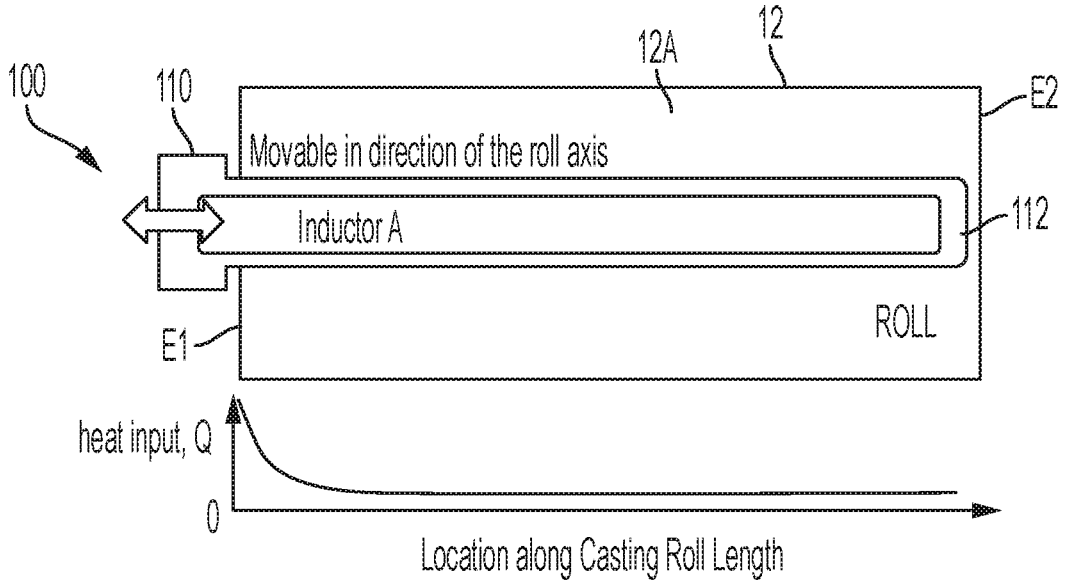
FIG. 11 is a rear view of a casting roll with an induction heat source, the induction heat source forming a single turn inductor including a transformer operably connected to a single continuous winding running the substantial length of the roll and back, the inductor being configured to heat the substantial length of the casting roll, resulting in elevated heating at an edge of the casting roll located at a casting roll end, the inductor being translatable in an axial direction of the casting roll, where below the view of the casting roll is a chart showing the variable application of heat input along the length of the casting roll, where more heat is being applied at the edge relative to other portions of the casting roll.

With reference now to FIG. 11, in another variation an inductor 100 is shown in operation as a heat source for a temperature altering source 100. Specifically, the induction heat source 100 is a single turn inductor having a transformer 110 and, extending therefrom and in operable communication therewith, a single continuous winding (coil) 112 that is configured to apply heat to the roll due its sufficiently close location to the roll 12. The winding 112 runs the substantial length of the roll 12 and back along a common length of casting roll 12. In this instance, while heat is applied generally uniformly across the length of the casting roll 12, a heightened amount of heat input is observed at an edge of the casting roll, located at an end $E_1$ of the casting roll 12. As a result, variable heat Q is applied to the casting roll by the inductor 100, as is reflected in the roll temperature chart located at the bottom of FIG. 11, such that the roll profile $P_{12}$ expands at the roll edge relative to other portions of the casting roll 12. In this example, inductor 100 is translatable in an axial direction (that is, in a direction of rotational axis A) of the casting roll 12. By moving the inductor 100 axially away from the roll edge E1, the inductor 100 would no longer extend the full length of the roll, thus removing the heating from the far edge of the roll E2.

Figure 12:
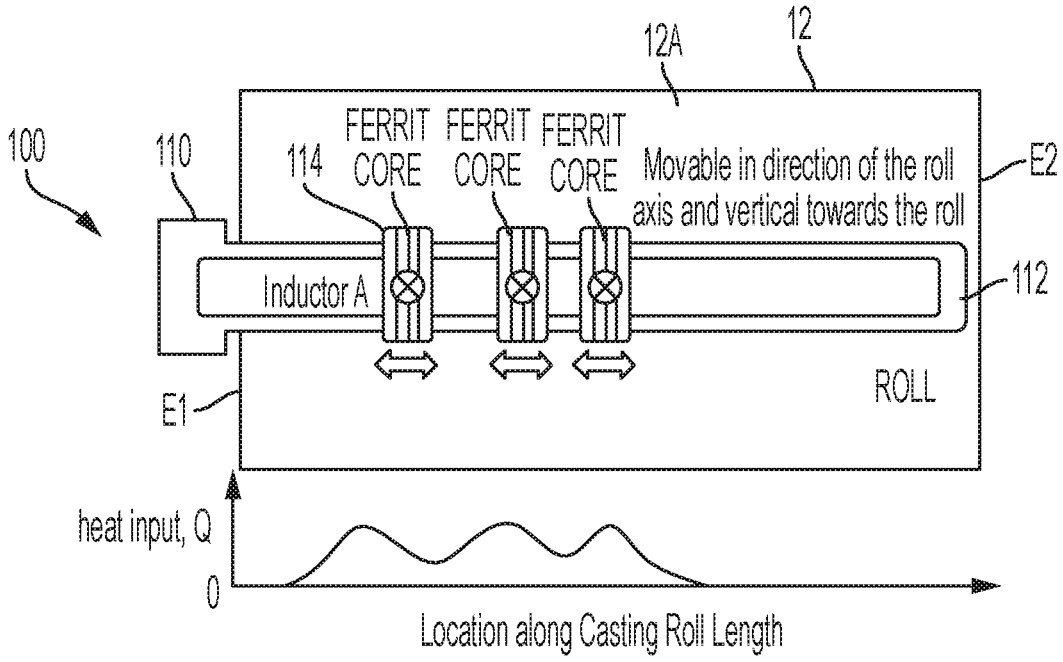
FIG. 12 is a rear view of a casting roll with an induction heat source, the induction heat source forming a single turn inductor including a transformer operably connected to a single continuous winding running the substantial length of the roll and back, the inductor also including a plurality of ferromagnetic cores each configured to control the input of heat into the casting roll by altering each core's proximity to the casting roll, each of the inductor and ferromagnetic cores being translatable in an axial direction of the casting roll, where below the view of the casting roll is a chart showing the variable application of heat input along the length of the casting roll.

With reference now to FIG. 12, a single turn inductor 100 as described in association with FIG. 11 is provided, with the exception that the winding 112 is located further from the roll surface 12A and the exception that the inductor includes a plurality of ferromagnetic cores 114 arranged along the length of the winding 112. Each core 114 functions as a different zone 102 of the temperature altering source 100. While each may remain stationary or fixed, in this variation the inductor 100 and ferromagnetic cores 114 are translatable along winding 112 in an axial direction of the casting roll 12. By locating the winding 112 further from the surface 12A (relative to FIG. 11), there is very little heating in the absence of the ferromagnetic cores 114, or in the areas where the ferromagnetic cores 114 are moved further away from the roll surface 12A such as in FIG. 10A. In FIG. 12, the plurality of cores 114 at various locations across the roll length are all placed in close proximity to the roll surface 12A such as in FIG. 10B, with the effect that variable heat Q is applied to the casting roll as is reflected in the roll temperature chart located at the bottom of FIG. 12, such that the roll profile $P_{12}$ expands at the locations associated with cores 114.

It is contemplated that more than one inductor 100 may be arranged along any casting roll. For example, with reference to FIGS. 13 and 14, multiple inductors 100 are provided.

Figure 13:
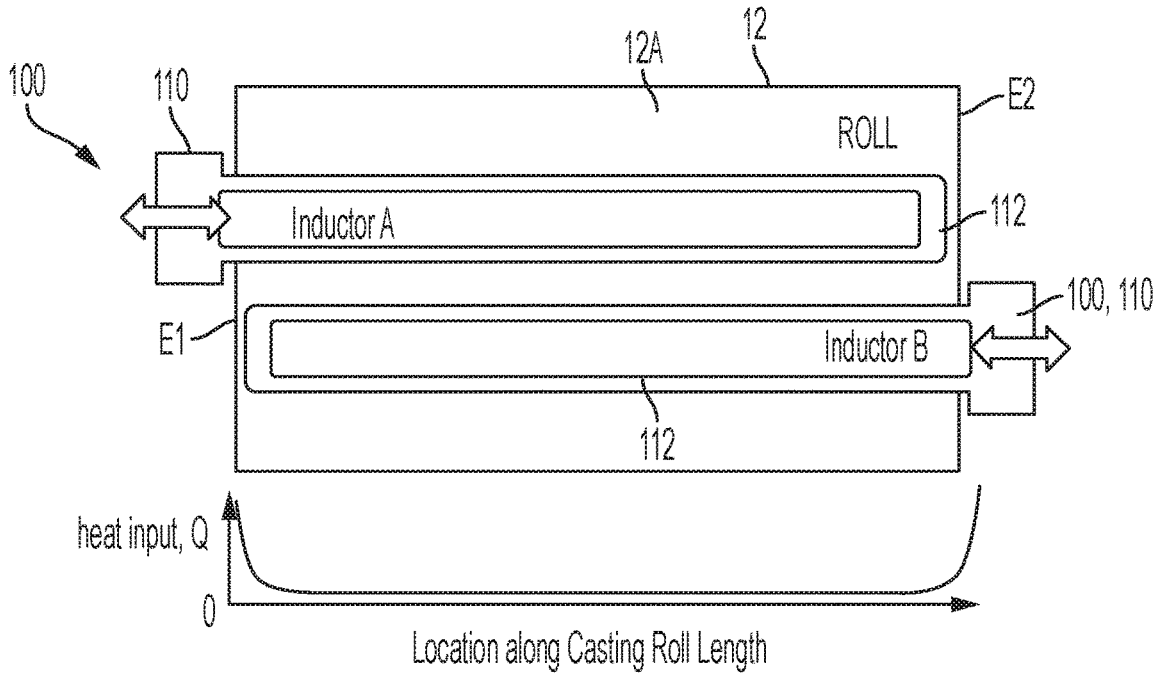
FIG. 13 is a rear view of a casting roll with a pair of induction heat sources, each induction heat source forming a single turn inductor including a transformer operably connected to a single continuous winding running the substantial length of the roll and back, each inductor being configured to heat the substantial length of the casting roll, resulting in elevated heating at each edge of the casting roll located at a casting roll end, each inductor being translatable in an axial direction of the casting roll, where below the view of the casting roll is a chart showing the variable application of heat input along the length of the casting roll, where more heat is being applied at each edge relative to other portions of the casting roll; and, FIG. 14 is a rear view of a casting roll with a pair of induction heat sources, each induction heat source forming a single turn inductor including a transformer operably connected to a single continuous winding running the substantial length of the roll and back, each inductor including a plurality of ferromagnetic cores each configured to control the input of heat into the casting roll by altering each core's proximity to the casting roll, each inductor and ferromagnetic core being translatable in an axial direction of the casting roll, where below the view of the casting roll is a chart showing the variable application of heat input along the length of the casting roll and the resulting temperature variation across roll length.
Figure 14:
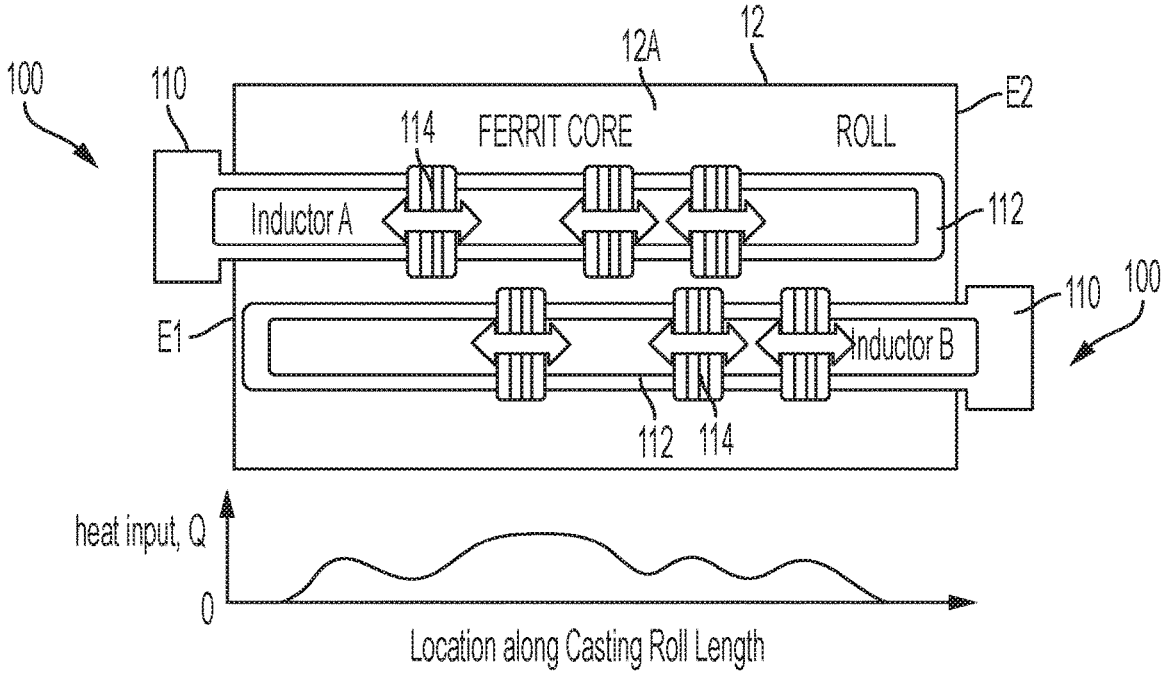

With reference to FIG. 13, a pair of inductors 100 is shown, each generally representing the inductor described in association with FIG. 11. In this arrangement, the entire roll length between ends $E_1$, $E_2$ are heated, which results in elevated heating at each edge of the casting roll, that is, at each of the opposing ends $E_1$, $E_2$ of roll 12, as is evident in the casting roll temperature chart arranged at the bottom of the FIG. 13. As a result, variable heating Q is observed by the casting roll 12. With reference to FIG. 14, a pair of inductors 100 is shown, each generally representing the inductor described in association with FIG. 12. In this arrangement, a plurality of translatable cores 114 are provided along each winding 112 to provide flexibility for selectively and variably heating different local locations along the roll length, ultimately altering the temperature of the casting roll 12 and casting surface 12A. Each core 114 is a different zone 102 of the inductor 100. This variable application of heat Q along the length of the casting roll is evident in the casting roll temperature chart arranged at the bottom of FIG. 14.

In view of the foregoing and in combination with the figures provided herewith, the following list identifies particular embodiments of the subject matter described and/or shown herein, in particular combinations, each of which may be expanded or narrowed as desired:

A method of continuously casting thin strip comprising: providing a pair of internally cooled counter-rotatable casting rolls having casting surfaces laterally positioned to form a gap at a nip between the casting rolls through which a thin metal strip having a thickness of less than 3 mm can be cast, where the casting surface of each casting roll has a roll profile extending in an axial direction of the corresponding casting roll providing a metal delivery system adapted to deliver molten metal above the nip to form a casting pool, the casting pool being supported on the casting surfaces of the pair of counter-rotatable casting rolls and confined at the ends of the casting rolls, delivering a molten steel to the metal delivery system; delivering the molten metal from the metal delivery system above the nip to form the casting pool;

counter rotating the pair of counter-rotatable casting rolls to form metal shells on the casting surfaces of the casting rolls that are brought together at the nip to deliver the thin metal strip downwardly, the thin metal strip having a thickness less than 3 mm and an initial thickness profile; and, altering the roll profile of at least one of the casting rolls by altering a temperature of the corresponding casting roll at any one or more local locations along a length of the corresponding casting roll.

The method as above, where altering the temperature of the corresponding casting roll at any one or more locations along the length of the corresponding casting roll is performed using a temperature altering source external to the casting rolls having one or more zones configured to locally heat and/or cool the corresponding casting roll, where each of the one or more zones of the temperature altering source corresponds with one of the one or more locations of the corresponding casting roll.

The method as above, where the temperature altering source includes a heat source arranged in each of the one or more zones.

The method as above, where the heat source is selected from a group consisting of an array of lasers, a focused scanning laser, an electrical radiation source, a gas burning radiation tube, an induction heating source, and a direct flame impingement source.

The method as above, where the array of lasers comprises vertical-cavity surface emitting laser arrays.

The method as above further comprising:

determining a need to alter the roll profile of at least one casting roll of the pair of counter-rotating casting rolls; where the step of altering the roll profile is performed in response to determining the need to alter the roll profile, where in the step of altering the roll profile of at least one of the pair of counter-rotating casting rolls is altered by altering a temperature of the corresponding casting roll at any one or more local locations along a length of the corresponding casting roll; and, counter rotating the pair of counter-rotatable casting rolls subsequent to altering the roll profile of at least one of the pair of counter-rotating casting rolls to form metal shells on the casting surfaces of the casting rolls that are brought together at the nip to deliver the thin metal strip downwardly, the thin metal strip having a thickness less than 3 mm and an altered thickness profile, the altered thickness profile being different than the initial thickness profile.

The method as above, where determining a need to alter the casting roll profile of at least one of the pair of counter rotating casting rolls is based upon the initial thickness profile of the cast strip.

The method as above, where determining a need to alter the casting roll profile of at least one of the pair of counter rotating casting rolls is based upon a cross-width temperature distribution of the cast strip.

The method as above, where each of the one or more zones has a zone width greater than or equal to 5 millimeters and less than or equal to a length of at least one of the pair of counter rotating casting rolls.

The method as above, where at least one of the one or more zones provides a heat input to the corresponding location of the at least one of the pair of counter rotating rolls, where the heat input is greater than or equal to 0.1 Megawatt per square meter and less than or equal to 10 Megawatts per square meter.

The method as above, where the temperature altering source is arranged in a location immediately prior to a location in which at least one of the pair of counter rotating casting rolls enters the casting pool.

The method as above, where the temperature altering source includes a cooling source.

The method as above, where the cooling source utilizes cryogenic gas.

The method as above, where altering the temperature of the corresponding casting roll at any one or more locations along the length of the corresponding casting roll occurs while the pair of counter-rotatable casting rolls are counter rotating as the thin metal strip is being delivered from the pair of casting rolls.

The method as above, where the induction heating source forms a plurality of inductors arranged in an array along the length of each corresponding casting roll.

The method as above, where in altering the casting roll profile, power to each of the one or more individual inductors is variably provided to provide a desired amount of heat.

The method as above, where the induction heating source includes:

a transformer and an electrically conductive winding in operable communication with the transformer, the winding forming an electrically conductive member extending generally parallel to the rotational axis of the casting roll, the winding having a first length and a second length, each of the first and second lengths extending along a common width of the corresponding casting roll, a plurality of ferromagnetic cores arranged along the common width, each core extending across both the first and second lengths of the continuous winding such that the continuous winding is arranged between each core and the corresponding casting roll and where each of the one or more zones are defined by one or more of the ferromagnetic cores.

The method as above, where, in altering the temperature of the corresponding casting roll at any one or more locations along the length of the corresponding casting roll, heat generated by the inductive heating source is controlled by moving each of the individual cores closer to and/or further away from the single, continuous winding coil.

The method as above, where each of the cores are configured to translate along the continuous winding for at least a portion of the common width.

An apparatus for continuously casting thin strip comprising:

a pair of internally cooled counter-rotatable casting rolls having casting surfaces, the pair of casting rolls laterally positioned to form a gap at a nip between the casting rolls through which a thin metal strip having a thickness of less than 3 mm can be cast, where the casting surface of each casting roll has a roll profile extending in an axial direction of the corresponding casting roll;

a metal delivery system adapted to deliver molten metal above the nip to form a casting pool, the casting pool being supported on the casting surfaces of the pair of counter-rotatable casting rolls and confined at the ends with a pair of side dams; and a temperature altering source external to the casting rolls and having one or more zones configured to alter the casting roll profile of at least one of the pair of casting rolls, where the temperature altering source is configured to change the temperature of the corresponding casting roll at any one or more locations along a length of the corresponding casting roll, where the one or more zones of the temperature altering source are configured to locally heat and/or cool the corresponding casting roll.

The apparatus as above, where the temperature altering source includes a heat source arranged in each of the one or more zones.

The apparatus as above, where the heat source is selected from the group consisting of an array of lasers, an electrical radiation source, a gas burning radiation tube, an induction heating source, and a direct flame impingement source.

The apparatus as above, where the array of lasers comprises vertical-cavity surface emitting laser arrays.

The apparatus as above, where each of the one or more zones has a zone width greater than or equal to 5 millimeters and less than or equal to a length of at least one of the pair of counter rotating casting rolls.

The apparatus as above, where at least one of the one or more zones provides a heat input to the corresponding location of the at least one of the pair of counter rotating rolls, where the heat input is greater than or equal to 0.1 Megawatt per square meter and less than or equal to 10 Megawatts per square meter.

The apparatus as above, where the temperature altering source includes a cooling source.

The apparatus as above, where the cooling source utilizes cryogenic gas.

The apparatus as above, where the induction heating source forms a plurality of inductors arranged in an array along the length of each corresponding casting roll.

The apparatus as above, where the induction heating source includes:

a transformer and an electrically conductive winding in operable communication with the transformer, the winding forming an electrically conductive member extending generally parallel to the rotational axis of the casting roll, the winding having a first length and a second length, each of the first and second lengths extending along a common width of the corresponding casting roll, a plurality of ferromagnetic cores arranged along the common width, each core extending across both the first and second lengths of the continuous winding such that the continuous winding is arranged between each core and the corresponding casting roll and where each of the one or more zones are defined by one or more of the ferromagnetic cores.

The apparatus as above, where each of the individual cores are configured to move closer to and/or further away from the single, continuous winding to vary the power output of each zone.

The apparatus as above, where each of the cores are translatable along the continuous winding for at least a portion of the common width.

The apparatus as above, where the temperature altering source is arranged in a location immediately prior to a location in which at least one of the pair of counter rotating casting rolls enters the casting pool.

The apparatus as above further comprising:

one or more sensors that each provide a sensor output signal that is a function of either the thickness profile of the thin metal strip delivered from the pair of counter-rotatable casting rolls or a temperature of the casting surface of at least one of the pair of casting rolls;

a controller comprising a processor and a memory storage device that stores instructions executable by the processor, such executable instructions including:

receiving instructions for receiving a signal from a sensor, the sensor sensing a measured parameter for determining a need to alter the roll profile of at least one casting roll of the pair of counter-rotating casting rolls, the signal being received from one or more locations along a width of the thin metal strip or along a length of at least one of the pair of casting rolls, the signal being generated by the sensor as a function of a measured parameter associated with the roll profile, a temperature of the thin metal strip or casting roll, or of a thickness profile of the thin metal strip;

interpreting instructions for interpreting the sensor signal as a measured parameter associated with the roll profile, temperature of the thin metal strip or casting roll, or thickness profile; and, altering instructions for altering a roll profile of at least one of the casting rolls by altering a temperature of the corresponding casting roll at any one or more local locations along a width of the corresponding casting roll.

The apparatus as above, where the altering instructions comprise:

determining instructions for determining a need to alter the roll profile of at least one casting roll of the pair of counter-rotating casting rolls based upon the sensor output signal;

where the altering instructions include, in response to determining the need to alter the roll profile, altering instructions for altering the roll profile of at least one of the pair of counter-rotating casting rolls by altering a temperature of the corresponding casting roll at any one or more local locations along a length of the corresponding casting roll using the temperature altering source.

The apparatus as above, where the sensor output signal is a function of an initial thickness profile of the cast strip.

The apparatus as above, where the sensor output signal is a function of a cross-width temperature distribution of the cast strip.

The apparatus as above, where the altering instructions provide that the altering of the temperature of the corresponding casting roll at any one or more locations along the length of the corresponding casting roll occurs while the pair of counter-rotatable casting rolls are counter rotating as the thin metal strip is being delivered from pair of casting rolls.

The apparatus as above, where the heat source is an induction heating source forming a plurality of inductors arranged in an array along the length of each corresponding casting roll, where the altering instructions provide that in altering the casting roll profile, power to each of the one or more individual inductors is variably provided to provide a desired amount of heat.

The apparatus as above, where the heat source is an induction heating source forming a plurality of inductors arranged in an array along the length of each corresponding casting roll, where the induction heating source includes: a transformer and an electrically conductive winding in operable communication with the transformer, the winding forming an electrically conductive member extending generally parallel to the rotational axis of the casting roll, the winding having a first length and a second length, each of the first and second lengths extending along a common width of the corresponding casting roll, a plurality of ferromagnetic cores arranged along the common width, each core extending across one or a pair of windings such that the continuous winding(s) are arranged between each core and the corresponding casting roll and where each of the one or more zones are defined by one or more of the ferromagnetic cores, where the altering instructions provide that in altering the temperature of the corresponding casting roll at any one or more locations along the length of the corresponding casting roll, heat generated by the inductive heating source is controlled by moving each of the individual cores closer to and/or further away from the single, continuous winding.

A computer program product including instructions embodied on a computer readable storage medium for altering the roll profile of a casting roll of a twin roll caster configured to form thin metal strips, the computer program comprising: receiving instructions for receiving a signal from a sensor, the sensor sensing a measured parameter for determining a need to alter the roll profile of at least one casting roll of the pair of counter-rotating casting rolls, the signal being received from one or more locations along a width of the thin metal strip or along a length of at least one of the pair of casting rolls, the signal being generated by the sensor as a function of a measured parameter associated with the roll profile, a temperature of the thin metal strip or casting roll, or of a thickness or thickness profile of the thin metal strip; interpreting instructions for interpreting the sensor signal as a measured parameter associated with the roll profile, temperature of the thin metal strip or casting roll, or strip thickness or thickness profile; and, altering instructions for altering a roll profile of at least one of the casting rolls by altering a temperature of the corresponding casting roll at any one or more local locations along a length of the corresponding casting roll.

The product as above, where the controlling instructions comprise:

determining instructions for determining a need to alter the roll profile of at least one casting roll of the pair of counter-rotating casting rolls based upon the sensor output signal; altering instructions for altering the roll profile of at least one of the pair of counter-rotating casting rolls by altering a temperature of the corresponding casting roll at any one or more local locations along a length of the corresponding casting roll using the temperature altering source.

A thin metal strip formed in accordance with any process described or contemplated herein.

While it has been described with reference to certain embodiments, it will be understood by those skilled in the art that various changes may be made and equivalents may be substituted without departing from scope. In addition, many modifications may be made to adapt a particular situation or material to the teachings without departing from its scope. Therefore, it is intended that it not be limited to the particular embodiments disclosed, but that it will include all embodiments falling within the scope of the appended claims.

What is claimed is:

1. A method of continuously casting thin metal strip comprising:

providing a pair of internally cooled counter-rotatable casting rolls having casting surfaces laterally positioned to form a gap at a nip between the casting rolls through which a thin metal strip having a thickness of less than 3 mm is cast, where the casting surface of each casting roll of the pair of internally cooled counter rotatable casting rolls has a roll profile extending in an axial direction of a corresponding casting roll, providing a metal delivery system adapted to deliver molten metal above the nip to form a casting pool, the casting pool being supported on the casting surfaces of the pair of internally cooled counter-rotatable casting rolls and confined at the ends of the casting rolls, delivering a molten metal to the metal delivery system;

delivering the molten metal from the metal delivery system above the nip to form the casting pool;

counter rotating the pair of internally cooled counter-rotatable casting rolls to form metal shells on the casting surfaces of the casting rolls that are brought together at the nip to deliver the thin metal strip downwardly, the thin metal strip having a thickness less than 3 mm and an initial thickness profile; and, altering the roll profile of at least one of the pair of internally cooled counter rotating casting rolls by altering a temperature of the corresponding casting roll at a plurality of local locations along a length of the corresponding casting roll;

using a plurality of electrical radiation heat sources external to an adjacent to the corresponding casting roll and corresponding to each of the plurality of local locations to locally apply heat directly to the corresponding casting roll.

2. The method of claim 1 further comprising:

determining a need to alter the roll profile of at least one casting roll of the pair of internally cooled counter-rotating casting rolls;

where the step of altering the roll profile is performed in response to determining the need to alter the roll profile, where in the step of altering the roll profile of at least one of the pair of counter-rotating casting rolls is altered by altering a temperature of the corresponding casting roll at one or more local locations along a length of the corresponding casting roll; and, counter rotating the pair of internally cooled counter-rotatable casting rolls subsequent to altering the roll profile of at least one of the pair of counter-rotating casting rolls to form metal shells on the casting surfaces of the casting rolls that are brought together at the nip to deliver the thin metal strip downwardly, the thin metal strip having a thickness less than 3 mm and an altered thickness profile, the altered thickness profile being different than the initial thickness profile.

3. The method of claim 2, where determining a need to alter the roll profile of at least one of the pair of internally cooled counter rotating casting rolls is based upon the initial thickness profile of the thin metal strip.

4. The method of claim 2, where determining a need to alter the roll profile of at least one of the pair of internally cooled counter rotating casting rolls is based upon a cross-width temperature distribution of the thin metal strip.

5. The method of claim 2, where altering the temperature of the corresponding casting roll at any one or more locations along the length of the corresponding casting roll occurs while the pair of internally cooled counter-rotatable casting rolls are counter rotating as the thin metal strip is being delivered from the pair of internally cooled counter-rotatable casting rolls.

6. The method of claim 1 each zone has a zone width greater than or equal to 5 millimeters and less than a length of at least one of the pair of internally cooled counter rotating casting rolls.

7. The method of claim 1, where each at least one of the plurality of zones provides a heat input to the corresponding location of the at least one of the pair of internally cooled counter rotating casting rolls, where the heat input is greater than or equal to 0.1 Megawatt per square meter and less than or equal to 10 Megawatts per square meter.

8. The method of claim 1, where the heat source is arranged in a location prior to a location in which at least one of the pair of internally cooled counter rotating casting rolls enters the casting pool.

9. The method of claim 1, wherein power to each of the plurality of electrical radiation sources is varied to provide an amount of heat to achieve the altered roll profile.

10. An apparatus for continuously casting thin metal strip comprising:

a pair of internally cooled counter-rotatable casting rolls having casting surfaces, the pair of internally cooled counter-rotatable casting rolls laterally positioned to form a gap at a nip between the casting rolls through which a thin metal strip having a thickness of less than 3 mm is cast, where the casting surface of each casting roll of the pair of internally cooled counter-rotatable casting rolls has a roll profile extending in an axial direction of a corresponding casting roll;

a metal delivery system adapted to deliver molten metal above the nip to form a casting pool, the casting pool being supported on the casting surfaces of the pair of internally cooled counter-rotatable casting rolls and confined at the ends with a pair of side dams; and a temperature altering source external to and adjacent to the casting roll and having a plurality of zones configured to alter the casting roll profile of at least one of the pair of internally cooled counter-rotatable casting rolls, where the temperature altering source is configured to change the temperature of the corresponding casting roll at a plurality of locations along a length of the corresponding casting roll, where the plurality of zones of the temperature altering source are configured to locally apply heat directly to the corresponding casting roll;

wherein the temperature altering source comprises a plurality of electrical radiation heat sources corresponding to the plurality of zones.

11. The apparatus of claim 10, where each zone has a zone width greater than or equal to 5 millimeters and less than a length of at least one of the pair of internally cooled counter rotating casting rolls.

12. The apparatus of claim 10, where at least one of the plurality of zones provides a heat input to the corresponding location of the at least one of the pair of counter rotating rolls greater than or equal to 0.1 Megawatt per square meter and less than or equal to 10 Megawatts per square meter.

13. The apparatus of claim 10, wherein the electrical radiation heat source comprises an induction heating source, and the induction heating source forms a plurality of inductors arranged in an array along the length of each corresponding casting roll.

14. The apparatus of claim 13, wherein the pair of internally cooled counter-rotatable casting rolls are formed from copper or copper alloy and are chromium plated.

15. The apparatus of claim 13, wherein the pair of internally cooled counter-rotatable casting rolls are formed from copper or copper alloy and are nickel plated.

16. The apparatus of claim 10, where the temperature altering source is arranged in a location prior to a location in which at least one of the pair of internally cooled counter rotatable casting rolls enters the casting pool.

17. The apparatus of claim 10 further comprising:

one or more sensors that each provide a sensor output signal that is a function of either the thickness profile of the thin metal strip delivered from the pair of internally cooled counter-rotatable casting rolls or a temperature of the casting surface of at least one of the pair of internally cooled counter-rotatable casting rolls;

a controller comprising a processor and a memory storage device that stores instructions executable by the processor, such executable instructions including:

receiving instructions for receiving a signal from a sensor, the sensor sensing a measured parameter for determining a need to alter the roll profile of at least one casting roll of the pair of internally cooled counter-rotatable casting rolls, the signal being received from one or more locations along a width of the thin metal strip or along a length of at least one of the pair of internally cooled counter-rotatable casting rolls, the signal being generated by the sensor as a function of a measured parameter associated with the roll profile, a temperature of the thin metal strip or casting roll, or of a thickness profile of the thin metal strip;

interpreting instructions for interpreting the sensor signal as a measured parameter associated with the roll profile, temperature of the thin metal strip or casting roll, or thickness profile; and, altering instructions for altering a roll profile of at least one of the casting rolls of the pair of internally cooled counter-rotatable casting rolls by altering a temperature of the corresponding casting roll at any one or more local locations along a width of the corresponding casting roll.

18. The apparatus of claim 17, where the altering instructions comprise:

determining instructions for determining a need to alter the roll profile of at least one casting roll of the pair of internally cooled counter-rotatable casting rolls based upon the sensor output signal;

where the altering instructions include, in response to determining the need to alter the roll profile, altering instructions for altering the roll profile of at least one of the pair of counter-rotating casting rolls by altering a temperature of the corresponding casting roll at any one or more local locations along a length of the corresponding casting roll using the temperature altering source.

19. The apparatus of claim 17, where the sensor output signal is a function of an initial thickness profile of the thin metal strip.

20. The apparatus of claim 17, where the sensor output signal is a function of a cross-width temperature distribution of the thin metal strip.

21. The apparatus of claim 17, where the altering instructions provide that the altering of the temperature of the corresponding casting roll at one or more local locations along the length of the corresponding casting roll occurs while the pair of internally cooled counter-rotatable casting rolls are counter rotating as the thin metal strip is being delivered from the pair of internally cooled counter-rotatable casting rolls.

22. The apparatus of 17, wherein each electrical radiation heat source is an induction heating source forming a plurality of inductors arranged in an array along the length of each corresponding casting roll, where the altering instructions provide that in altering the roll profile, power to each of the one or more individual inductors is variably provided to provide a desired amount of heat.

23. The apparatus of claim 10, wherein the internal cooling is provided by longitudinal cooling passages.

24. The apparatus of claim 10, wherein power to each of the plurality of electrical radiation sources is varied to provide an amount of heat to achieve the altered roll profile.

* * * * *